US010806191B2

(12) United States Patent
Hashiguchi et al.

(10) Patent No.: US 10,806,191 B2
(45) Date of Patent: Oct. 20, 2020

(54) GARMENT CONNECTOR

(71) Applicant: Japan Aviation Electronics Industry, Limited, Tokyo (JP)

(72) Inventors: Osamu Hashiguchi, Tokyo (JP); Akihiro Matsunaga, Tokyo (JP); Seiya Matsuo, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/400,217

(22) Filed: May 1, 2019

(65) Prior Publication Data

US 2020/0022425 A1 Jan. 23, 2020

(30) Foreign Application Priority Data

Jul. 18, 2018 (JP) ..... 2018-135200

(51) Int. Cl.
*A41D 1/00* (2018.01)
*H01R 13/24* (2006.01)
*H01R 13/66* (2006.01)

(52) U.S. Cl.
CPC ..... *A41D 1/005* (2013.01); *H01R 13/2471* (2013.01); *H01R 13/665* (2013.01)

(58) Field of Classification Search
CPC ... A41D 1/005; H01R 13/2471; H01R 13/665
See application file for complete search history.

(56) References Cited

U.S. PATENT DOCUMENTS

| | | | | |
|---|---|---|---|---|
| 9,252,515 | B2 * | 2/2016 | Komoto | H01R 13/24 |
| 9,893,478 | B2 * | 2/2018 | Komoto | H01R 13/73 |
| 10,109,963 | B2 * | 10/2018 | Komoto | A41D 1/002 |
| 10,498,097 | B2 * | 12/2019 | Komoto | A41D 1/002 |
| 2006/0280322 | A1 * | 12/2006 | Abe | H01R 13/24 381/300 |
| 2007/0026695 | A1 * | 2/2007 | Lee | H01R 13/6277 439/37 |
| 2009/0088652 | A1 * | 4/2009 | Tremblay | A41D 13/1281 600/388 |
| 2011/0306218 | A1 | 12/2011 | Chen | |
| 2017/0209738 | A1 * | 7/2017 | Brennan | G06K 9/00342 |
| 2017/0264978 | A1 * | 9/2017 | Leftly | A61B 5/6801 |
| 2017/0279230 | A1 * | 9/2017 | Komoto | H01R 13/73 |
| 2018/0212359 | A1 * | 7/2018 | Wei | A41D 13/0051 |

FOREIGN PATENT DOCUMENTS

| | | | |
|---|---|---|---|
| DE | 202016105258 U1 * | 10/2016 | A61N 1/0484 |
| DE | 20 2016 105 258 U1 | 11/2016 | |
| JP | 2015-135723 A | 7/2015 | |
| JP | 2017-182897 | 10/2017 | |

* cited by examiner

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

A garment connector includes a connector body, one or more contacts held by the connector body, one or more conductive members held by the connector body and corresponding to the one or more contacts, and a connector fixation member in a sheet-like shape held by the connector body and extending to an exterior of the connector body, the garment connector being attached to a garment by fixing the connector fixation member to the garment at the exterior of the connector body.

19 Claims, 11 Drawing Sheets

GARMENT CONNECTOR

BACKGROUND OF THE INVENTION

The present invention relates to a garment connector, particularly to a connector to be attached to a garment.

As a connector to be attached to a garment, for example, a connector 1 as illustrated in FIG. 26 is disclosed in JP 2017-182897 A. The connector 1 includes a garment-side connector portion 2 to be attached to a garment, and a module-side connector portion 3 to be fitted with the garment-side connector portion 2.

As illustrated in FIG. 27, the garment-side connector portion 2 includes a base member 4 in a disk shape and a frame member 5 attached to the base member 4. A plurality of contact portions 6 are arranged on the upper face of the base member 4 to form a circle and a plurality of external connection portions 6A connected respectively to the plurality of contact portions 6 are exposed to protrude from the peripheral edge portion of the upper face of the base member 4. Further, a plurality of protrusions 7 integrally formed with the base member 4 protrude from the peripheral edge portion of the upper face of the base member 4. While, a plurality of fitting holes (not illustrated) are formed in the lower face of the frame member 5.

By pressing the frame member 5 against the base member 4 in a state where a cloth 8 of garment is sandwiched between the base member 4 and the frame member 5, the plurality of external connection portions 6A of the base member 4 and the plurality of protrusions 7 are fitted into the plurality of fitting holes of the frame member 5 respectively, with the cloth 8 being sandwiched, to thereby allow the garment-side connector portion 2 to be attached to the cloth 8. Opening portions 9 are prepared in the cloth 8 beforehand and a plurality of wiring portions 10 are arranged on the back face of the cloth 8. The plurality of wiring portions 10 of the cloth 8 are respectively pressed into the fitting holes of the frame member 5 while being in contact with the corresponding external connection portions 6A of the base member 4, and are thereby connected to the external connection portions 6A.

The plurality of contact portions 6 of the base member 4 are exposed through opening portions 9 of the cloth 8. When the module-side connector portion 3 is fitted with the garment-side connector portion 2, a plurality of contact portions (not illustrated) of the module-side connector portion 3 come into contact with the plurality of contact portions 6 of the base member 4 and are electrically connected to the plurality of wiring portions 10 of the cloth 8 via the plurality of external connection portions 6A.

In this way, while sandwiching the cloth 8 of the garment between the base member 4 and the frame member 5, the connector 1 of JP 2017-182897 A makes the plurality of external connection portions 6A and the plurality of protrusions 7 of the base member 4 be fitted into the plurality of fitting holes of the frame member 5 respectively, to thereby allow the garment-side connector portion 2 to be attached to the cloth 8. Accordingly, in order to firmly attach the garment-side connector portion 2 to the garment, the sizes of the external connection portions 6A and the protrusions 7 of the base member 4 and the plurality of fitting holes of the frame member 5 need to be varied depending on the thickness of the cloth 8.

SUMMARY OF THE INVENTION

The present invention has been made in order to solve the above-described drawbacks in the related arts, and aims at providing a garment connector that can be readily attached to a garment irrespective of the thickness of the garment.

A garment connector according to the present invention includes a connector body, one or more contacts held by the connector body, one or more conductive members held by the connector body and corresponding to the one or more contacts, and a connector fixation member in a sheet-like shape held by the connector body and extending to an exterior of the connector body, wherein the garment connector is attached to a garment by fixing the connector fixation member to the garment at the exterior of the connector body.

DETAILED DESCRIPTION OF THE INVENTION

Hereinafter, embodiments of the invention will be described with reference to the accompanying drawings.

Embodiment 1

Figure 1:
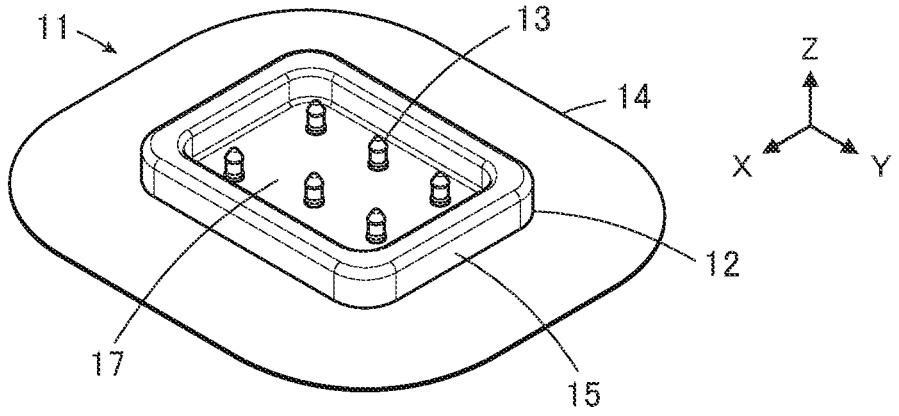
FIG. 1 is a perspective view of a garment connector according to Embodiment 1 of the present invention as viewed obliquely from above.
Figure 2:
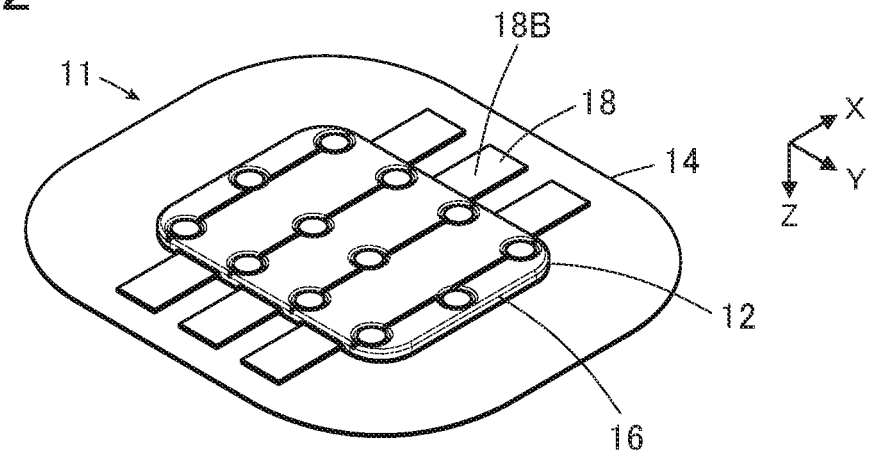
FIG. 2 is a perspective view of the garment connector according to Embodiment 1 as viewed obliquely from below.

FIGS. 1 and 2 illustrate a garment connector 11 according to Embodiment 1. For example, the garment connector 11 is used as a connector, to be attached to a garment, for making a wearable device be fitted therewith, and includes a connector body 12 made of an insulating material. A plurality of contacts 13 and a connector fixation member 14 in a sheet-like shape are held by the connector body 12.

The connector body 12 includes a first insulator 15 and a second insulator 16 to be coupled to the first insulator 15. The connector fixation member 14 is sandwiched to be held between the first insulator 15 and the second insulator 16 and extends to an exterior of the connector body 12 to seamlessly surround the outer peripheral portion of the connector body 12.

The first insulator 15 and the second insulator 16 both have a substantially rectangular flat plate shape. As illustrated in FIG. 1, the first insulator 15 includes a mating connector receiving portion 17 in a concave form, where the plurality of contacts 13 protrude into the mating connector receiving portion 17 perpendicularly to the bottom face of the mating connector receiving portion 17. Note that the mating connector receiving portion 17 is not necessarily formed in a concave form, and the first insulator 15 may have a flat plate shape.

As illustrated in FIG. 2, the garment connector 11 includes a plurality of conductive members 18 corresponding to the plurality of contacts 13 and held by the connector body 12. The plurality of conductive members 18 each include an internal conductive portion 18A to be described below, disposed inside the connector body 12 and to be electrically connected to the corresponding contact 13, and an external conductive portion 18B disposed outside the connector body 12, extending along the connector fixation member 14, and covered with the connector fixation member 14.

For ease of understanding, the short-side direction of the first insulator 15 and the second insulator 16 that are formed in substantially rectangular shapes is defined as the X direction, the long-side direction is defined as the Y direction, and the direction in which each contact 13 protrudes perpendicularly to the XY plane is defined as the +Z direction.

That is, six contacts 13 are arranged in two rows, with three in each row, substantially along the Y direction. Three conductive members 18 corresponding to three contacts 13 arranged on the +X direction side among the six contacts 13 are arranged to extend in the +X direction from the connector body 12, and three conductive members 18 corresponding to the three contacts 13 arranged on the −X direction side are arranged to extend in the −X direction from the connector body 12.

Figure 3:
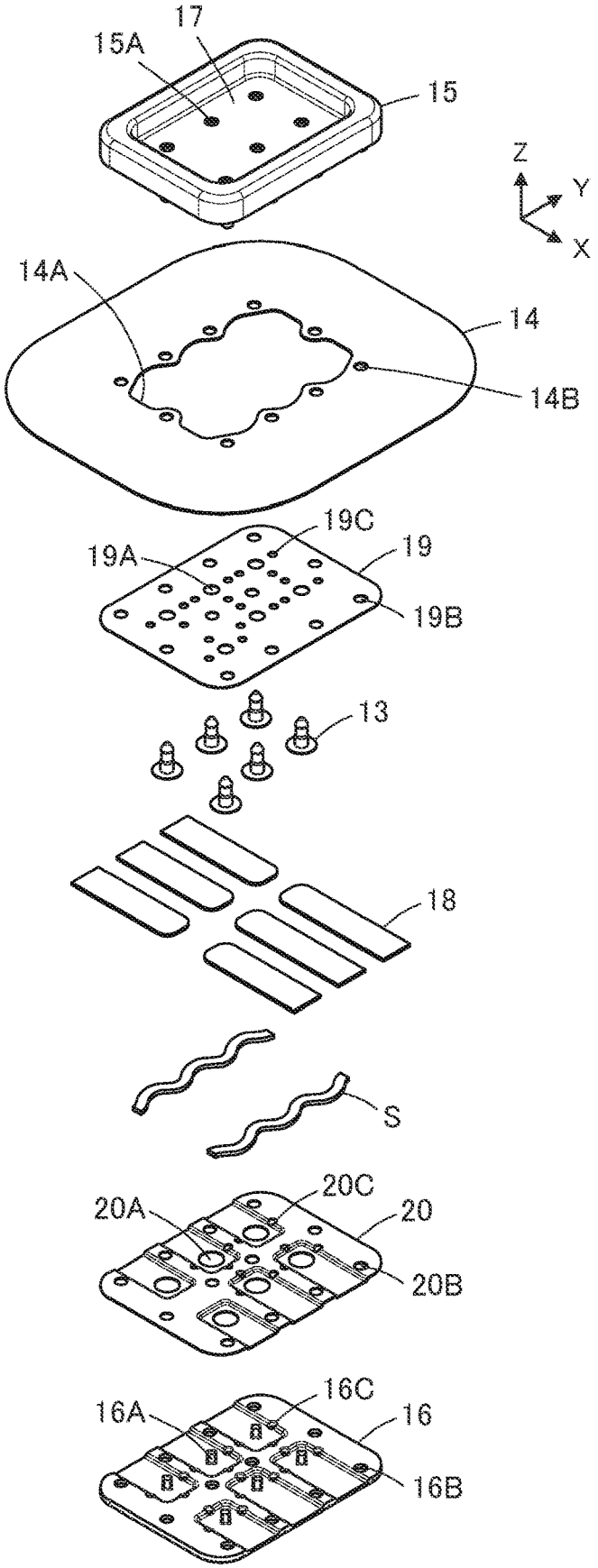
FIG. 3 is an exploded perspective view of the garment connector according to Embodiment 1.

As illustrated in FIG. 3, the garment connector 11 further includes a first waterproof sheet 19 disposed between the first insulator 15 and the plurality of conductive members 18, a second waterproof sheet 20 disposed between the plurality of conductive members 18 and the second insulator 16, and two permeable adhesive sheets S disposed between the plurality of conductive members 18 and the second waterproof sheet 20.

The first insulator 15 includes a plurality of contact attachment holes 15A through which the plurality of contacts 13 pass.

The connector fixation member 14 in a sheet-like shape has insulating properties and is made of resin or cloth. Moreover, the connector fixation member 14 includes an opening portion 14A located at the center and a plurality of through holes 14B formed along the peripheral edge of the opening portion 14A.

The first waterproof sheet 19 and the second waterproof sheet 20 are made of a solid adhesive in a sheet or film form having a rectangular shape approximately equivalent in size to the first insulator 15 and the second insulator 16. For example, a hot melt-type thermoplastic adhesive can be used as the first waterproof sheet 19 and the second waterproof sheet 20. The thermoplastic adhesive, which is also referred to as so-called hot melt adhesive, is a solid at room temperature, and form a bond by heating to melt and cooling to solidify.

The first waterproof sheet 19 and the second waterproof sheet 20 include a plurality of through holes 19A and 20A corresponding to the plurality of contacts 13, respectively, and a plurality of through holes 19B and 20B formed along the peripheral edges thereof, respectively. In addition, the first waterproof sheet 19 and the second waterproof sheet 20 includes a plurality of small through holes 19C and 20C arranged around the respective through holes 19A and 20A.

The plurality of conductive members 18 are each members fabricated into a cloth form using conductive fibers and have both conductivity and flexibility.

The permeable adhesive sheets S, like the first waterproof sheet 19 and the second waterproof sheet 20, are made of a solid adhesive. For example, a hot melt-type thermoplastic adhesive can be used as the permeable adhesive sheet S. However, the permeable adhesive sheets S are preferably an adhesive that has higher fluidity when being heated to melt than the adhesive of the first waterproof sheet 19 and the second waterproof sheet 20, and easily permeates into the interior of the plurality of conductive members 18.

The second insulator 16 includes a plurality of contact protrusions 16A corresponding to the plurality of contacts 13 and each protruding in the +Z direction and includes a plurality of through holes 16B formed along the peripheral edge. Further, the second insulator 16 includes a plurality of small concave portions 16C arranged around each contact protrusion 16A.

Figure 4:
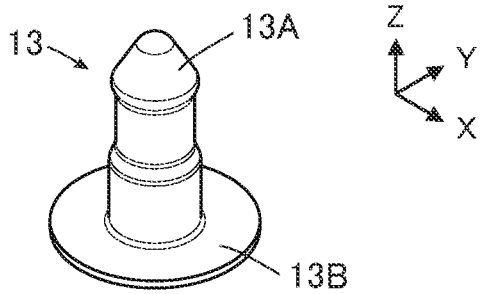
FIG. 4 is a perspective view showing a contact used for the garment connector of Embodiment 1.
Figure 5:
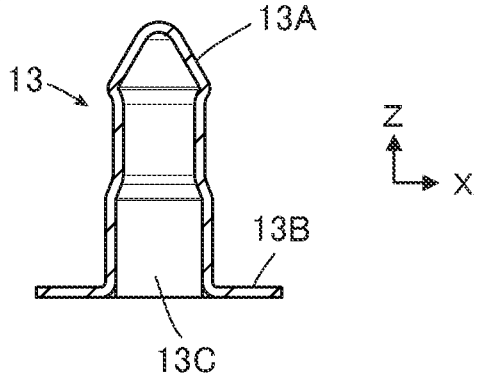
FIG. 5 is a cross-sectional view showing a contact used for the garment connector according to Embodiment 1.

As illustrated in FIG. 4, the contact 13 is a plug-type contact made of a conductive material such as a metal and includes a substantially cylindrical projecting portion 13A extending in the Z direction and a flange 13B extending along the XY plane from the base end of the projecting portion 13A in the −Z direction. As illustrated in FIG. 5, a protrusion receiving portion 13C in a concave form is formed inside the projecting portion 13A.

The plurality of contact attachment holes 15A of the first insulator 15 and the plurality of through holes 19A of the first waterproof sheet 19 each have an inner diameter that is slightly larger than the outer diameter of the projecting portion 13A of the contact 13 and smaller than the outer diameter of the flange 13B.

A method of assembling the garment connector 11 is herein described.

Figure 6:
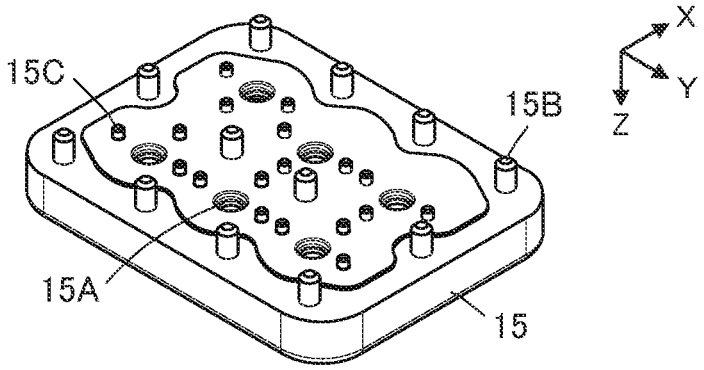
FIG. 6 is a perspective view showing a first insulator placed upside down in assembling the garment connector of Embodiment 1.

First, as illustrated in FIG. 6, the first insulator 15 is placed upside down on a workbench or the like. That is, the first insulator 15 is disposed so that the mating connector receiving portion 17 faces downward. Note that on the face of the first insulator 15 on the −Z direction side, there are formed a plurality of fixation protrusions 15B arranged along the peripheral edge of the first insulator 15 and each protruding in the −Z direction. The plurality of through holes 14B of the connector fixation member 14, the plurality of through holes 19B and 20B of the first waterproof sheet 19 and the second waterproof sheet 20, and the plurality of through holes 16B of the second insulator 16 are each formed at a position corresponding to each of the plurality of fixation protrusions 15B of the first insulator 15.

Further, on the face of the first insulator 15 on the −Z direction side, a plurality of small protrusions 15C are formed to protrude around each of the contact attachment holes 15A. The plurality of through holes 19C and 20C of the first waterproof sheet 19 and the second waterproof sheet 20 and the plurality of concave portions 16C of the second insulator 16 are each formed at a position corresponding to each of the plurality of protrusions 15C of the first insulator 15.

Figure 7:
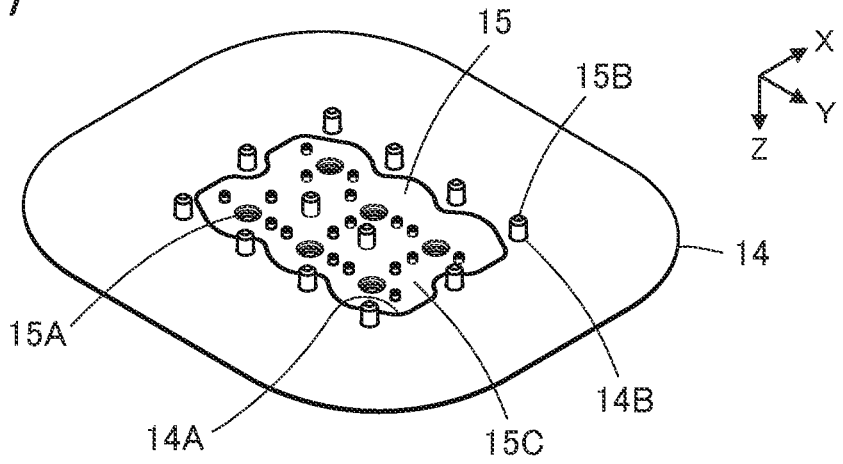
FIG. 7 is a perspective view illustrating a connector fixation member being overlapped on the first insulator in assembling the garment connector of Embodiment 1.

Next, as illustrated in FIG. 7, the connector fixation member 14 is disposed to overlap on the first insulator 15, that is, on the −Z direction side, and the plurality of fixation protrusions 15B of the first insulator 15 are passed through the plurality of through holes 14B of the connector fixation member 14. This allows the connector fixation member 14 to be aligned with respect to the first insulator 15.

As such, the plurality of contact attachment holes 15A and the plurality of protrusions 15C of the first insulator 15 are located within the opening portion 14A of the connector fixation member 14 and exposed through the opening portion 14A.

Figure 8:
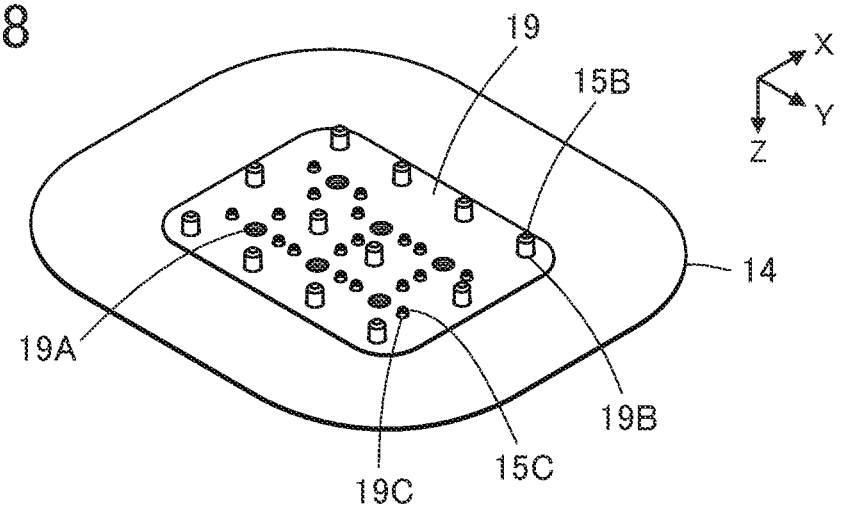
FIG. 8 is a perspective view illustrating a first waterproof sheet being disposed on the first insulator in assembling the garment connector of Embodiment 1.

Further, as illustrated in FIG. 8, the first waterproof sheet 19 is disposed to overlap on the first insulator 15 and the connector fixation member 14. The plurality of fixation protrusions 15B of the first insulator 15 are passed through the plurality of through holes 19B of the first waterproof sheet 19, and the plurality of small protrusions 15C of the first insulator 15 are passed through the plurality of small through holes 19C of the first waterproof sheet 19. This allows the first waterproof sheet 19 to be aligned with respect to the first insulator 15.

As such, the plurality of through holes 19A of the first waterproof sheet 19 are each located directly above the corresponding contact attachment hole 15A of the first insulator 15.

Figure 9:
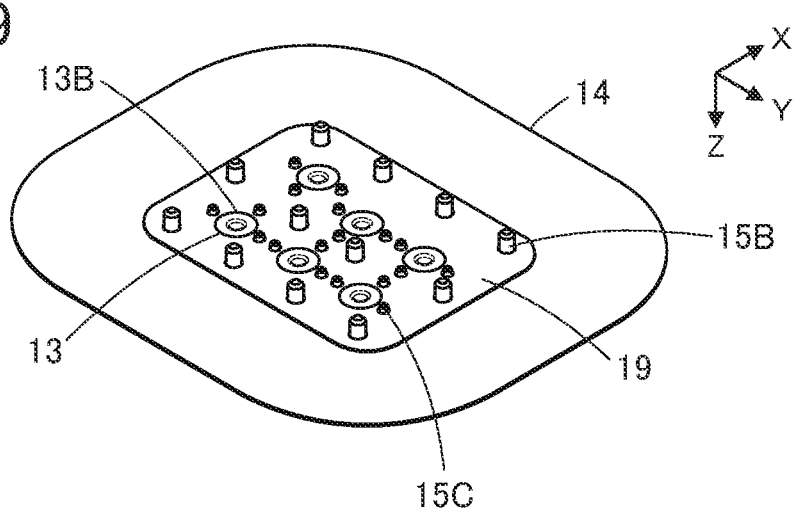
FIG. 9 is a perspective view illustrating the contacts being assembled into the first insulator and the first waterproof sheet in assembling the garment connector of Embodiment 1.

Then, as illustrated in FIG. 9, the plurality of contacts 13 are assembled into the plurality of through holes 19A of the first waterproof sheet 19. The projecting portions 13A of the plurality of contacts 13 are each inserted into the corresponding contact attachment hole 15A of the first insulator 15 through the corresponding through hole 19A of the first waterproof sheet 19 so as to protrude into the mating connector receiving portion 17 of the first insulator 15. Note that since the outer diameter of the flange 13B of the contact 13 is greater than the inner diameters of the contact attachment hole 15A of the first insulator 15 and the through hole 19A of the first waterproof sheet 19, the plurality of contacts 13 are held in such a manner that the respective flanges 13B are exposed from the first waterproof sheet 19, as illustrated in FIG. 9.

Figure 10:
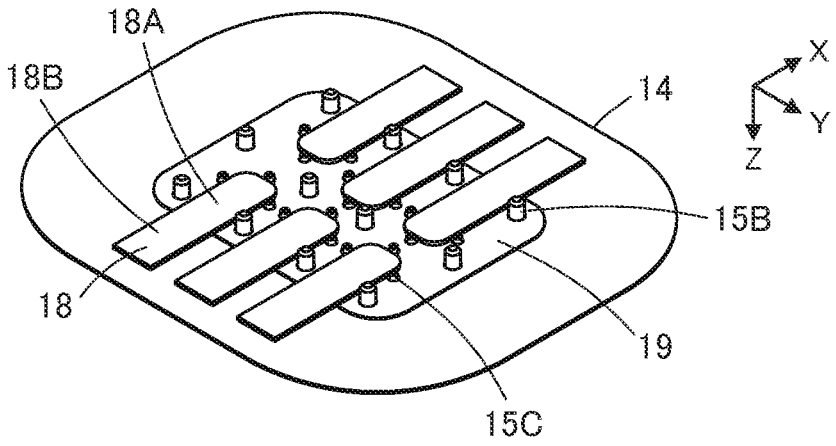
FIG. 10 is a perspective view illustrating conductive members being disposed on the first waterproof sheet and the contacts in assembling the garment connector of Embodiment 1.

Next, as illustrated in FIG. 10, the plurality of conductive members 18 are arranged on the first waterproof sheet 19 and the flanges 13B of the plurality of contacts 13. The conductive members 18 each include the internal conductive portion 18A disposed above the first waterproof sheet 19 and the external conductive portion 18B disposed outside the first waterproof sheet 19.

Note that among the six contacts 13, three conductive members 18 corresponding to the three contacts 13 arranged on the +X direction side are arranged to extend in the +X direction from above the first waterproof sheet 19, while three conductive members 18 corresponding to the three contacts 13 arranged on the −X direction side are arranged to extend in the −X direction from above the first waterproof sheet 19.

As such, the leading ends of the internal conductive portions 18A of the respective conductive members 18 are each located directly above the flange 13B of the corresponding contact 13. However, since the leading ends of the internal conductive portions 18A of the conductive members 18 are brought into contact with the plurality of small protrusions 15C formed to protrude around the contact attachment holes 15A of the first insulator 15, the arrangement positions are restricted. As a result, the plurality of conductive members 18 are prevented from coming into contact with each other to be electrically short-circuited.

Figure 11:
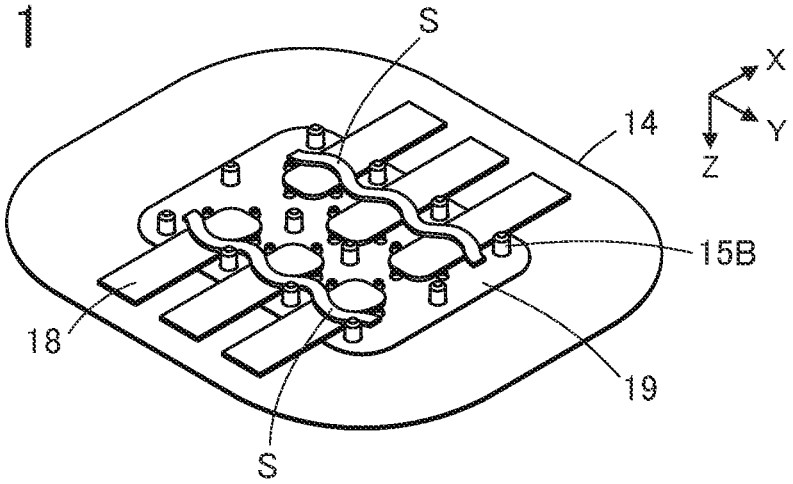
FIG. 11 is a perspective view illustrating permeable adhesive sheets being disposed on the conductive members in assembling the garment connector of Embodiment 1.

Further, as illustrated in FIG. 11, two permeable adhesive sheets S are arranged on the plurality of conductive members 18. The permeable adhesive sheet S located on the +X direction side of the two permeable adhesive sheets S is disposed to traverse, in substantially Y direction, the three conductive members 18 extending in the +X direction from above the first waterproof sheet 19 and to be located between the plurality of fixation protrusions 15B and the plurality of protrusions 15C arranged on the +X direction side of the first insulator 15. Also, the permeable adhesive sheet S located on the −X direction side of the two permeable adhesive sheets S is disposed to traverse, in substantially Y direction, the three conductive members 18 extending in the −X direction from above the first waterproof sheet 19 and to be located between the plurality of fixation protrusions 15B and the plurality of protrusions 15C arranged on the −X direction side of the first insulator 15.

Figure 12:
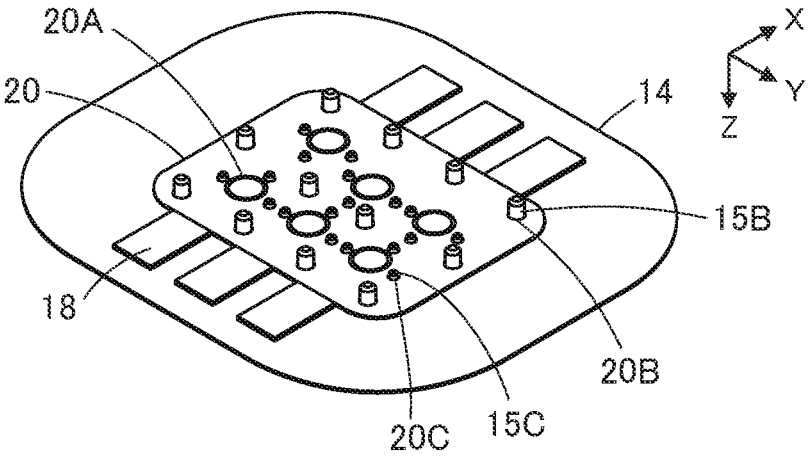
FIG. 12 is a perspective view illustrating a second waterproof sheet being disposed on the first waterproof sheet, the conductive members, and the permeable adhesive sheets in assembling the garment connector of Embodiment 1.

As illustrated in FIG. 12, the second waterproof sheet 20 is disposed to overlap on the first waterproof sheet 19, the plurality of conductive members 18, and the two permeable adhesive sheets S, where a plurality of fixation protrusions 15B of the first insulator 15 are passed through a plurality of through holes 20B of the second waterproof sheet 20 and the plurality of small protrusions 15C of the first insulator 15 are passed through a plurality of small through holes 20C of the second waterproof sheet 20. This allows the second waterproof sheet 20 to be aligned with respect to the first insulator 15.

Note that a plurality of through holes 20A of the second waterproof sheet 20 are to be located directly above one ends of the plurality of conductive members 18 arranged above the flanges 13B of the plurality of contacts 13.

Figure 13:
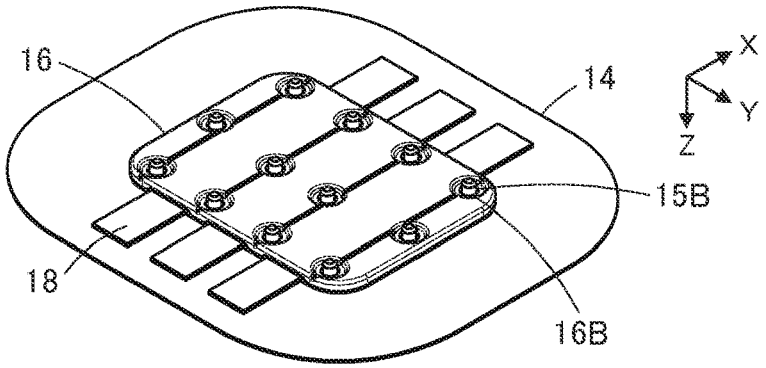
FIG. 13 is a perspective view illustrating a second insulator being disposed on the second waterproof sheet in assembling the garment connector of Embodiment 1.

Next, as illustrated in FIG. 13, the second insulator 16 is disposed to overlap on the second waterproof sheet 20, where the plurality of fixation protrusions 15B of the first insulator 15 are passed through the plurality of through holes 16B of the second insulator 16 and the plurality of protrusions 15C of the first insulator 15 are inserted into the plurality of concave portions 16C of the second insulator 16. This allows the second insulator 16 to be aligned with respect to the first insulator 15.

Figure 14:
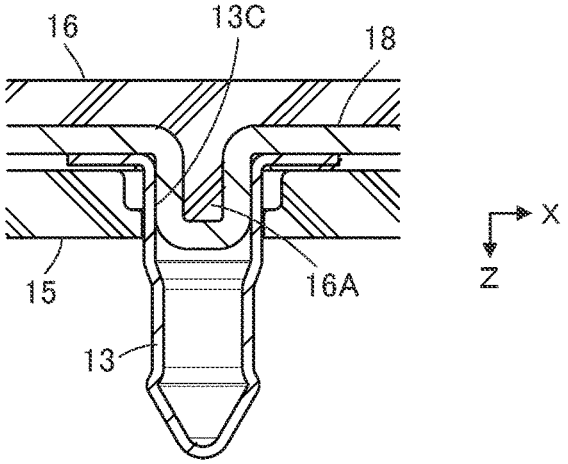
FIG. 14 is a partially enlarged cross-sectional view illustrating a contact when the second insulator is disposed.

At this time, as illustrated in FIG. 14, the contact protrusion 16A of the second insulator 16 protruding in the +Z direction is then inserted into the protrusion receiving portion 13C of the corresponding contact 13 with the conductive member 18 interposed in between. The conductive member 18 is protruded in the +Z direction and deformed by the contact protrusion 16A, and comes into contact with the inner peripheral face of the protrusion receiving portion 13C of the contact 13. This allows the plurality of contacts 13 to be each electrically connected to the corresponding conductive member 18.

In this way, in a state where the connector fixation member 14, the first waterproof sheet 19, the plurality of contacts 13, the plurality of conductive members 18, the two permeable adhesive sheets S, and the second waterproof sheet 20 are sandwiched between the first insulator 15 and the second insulator 16, the first waterproof sheet 19 and the second waterproof sheet 20 are subjected to a heat treatment to melt, and are then cooled to solidify. This allows the first insulator 15 and the second insulator 16 to adhere to each other and a waterproof layer composed of a solidified adhesive to be formed between the first insulator 15 and the second insulator 16, so that water is prevented from entering between the first insulator 15 and the second insulator 16.

The two permeable adhesive sheets S disposed on the plurality of conductive members 18 also melt by the heat treatment, where the permeable adhesive sheet S has high fluidity at the time of melting, thus the molten adhesive permeates into the conductive member 18 made of conductive fibers, and is then cooled to solidify. Accordingly, the adhesive forming the permeable adhesive sheet S enters and solidifies inside the conductive member 18, and this also prevents water from entering between the first insulator 15 and the second insulator 16 from the outside through the inside of the conductive member 18.

Subsequently, the leading end portions of the plurality of fixation protrusions 15B of the first insulator 15 protruding in the −Z direction from the plurality of through holes 16B of the second insulator 16 are heated to melt, thereby being fused to the surface on the −Z direction side of the second insulator 16. This allows the first insulator 15 and the second insulator 16 to be coupled to each other to form the connector body 12, whereby the assembling of the garment connector 11 illustrated in FIGS. 1 and 2 is completed.

Next, a method of attaching the garment connector 11 of Embodiment 1 to a garment will be described.

Figure 15:
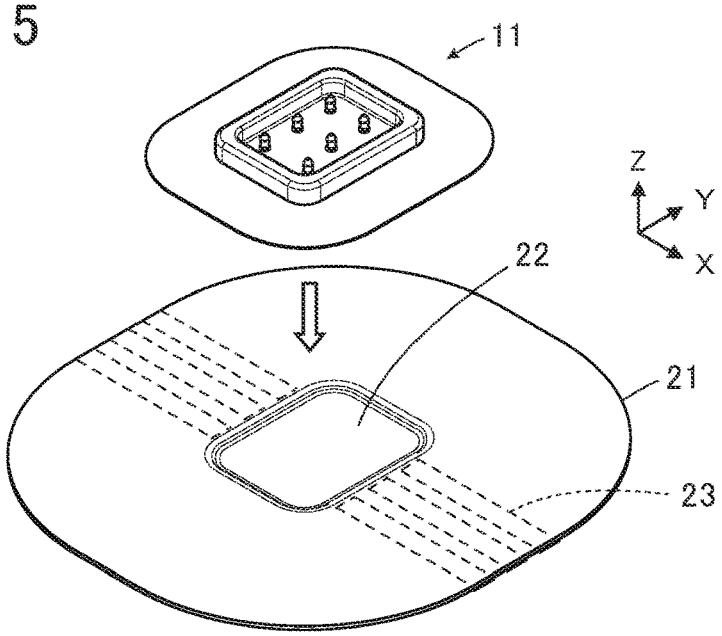
FIG. 15 is a perspective view illustrating the garment connector of Embodiment 1 being aligned above a garment.

First, as illustrated in FIG. 15, the garment connector 11 is located directly above a connector attachment position 22 on the front face of a cloth 21 of garment. Note that a plurality of garment-side conductor portions 23 corresponding to the plurality of conductive members 18 of the garment connector 11 are arranged on the back face of the cloth 21.

Figure 16:
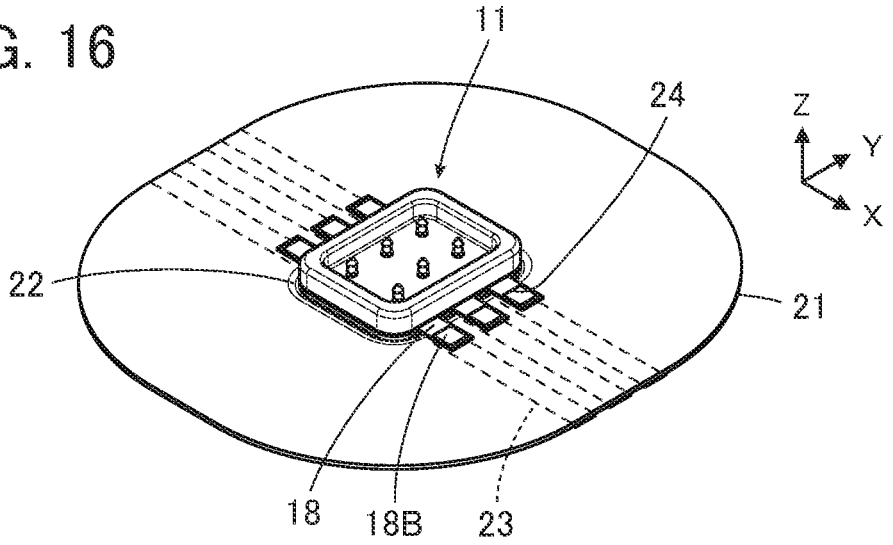
FIG. 16 is a perspective view illustrating the external conductive portions of the conductive members of the garment connector according to Embodiment 1 arranged on the front face of the garment being sewn to the garment.

When the garment connector 11 is located at the connector attachment position 22 of the cloth 21, the external conductive portions 18B of the plurality of conductive members 18 of the garment connector 11 are each located directly above the leading end portion of the corresponding garment-side conductor portion 23 disposed on the back face of the cloth 21 as illustrated in FIG. 16. That is, the external conductive portions 18B and the leading end portions of the garment-side conductor portions 23 corresponding to each other are arranged on both faces of the cloth 21 with the cloth 21 interposed in between.

Then, the external conductive portions 18B and the leading end portions of the garment-side conductor portion 23 corresponding to each other are sewn up together with the cloth 21 using a conductive yarn 24. This allows the plurality of conductive members 18 of the garment connector 11 to be each electrically connected to each of the plurality of garment-side conductor portions 23 of the cloth 21.

Note that, in FIG. 16, the illustration of the connector fixation member 14 is omitted to make the external conductive portions 18B of the plurality of conductive members 18 of the garment connector 11 easily viewable. In practice, the external conductive portions 18B of the plurality of conductive members 18 are covered by the connector fixation member 14. Thus, the external conductive portions 18B and the leading end portions of the garment-side conductor portions 23 corresponding to each other need to be sewn up while holding up the connector fixation member 14.

Figure 17:
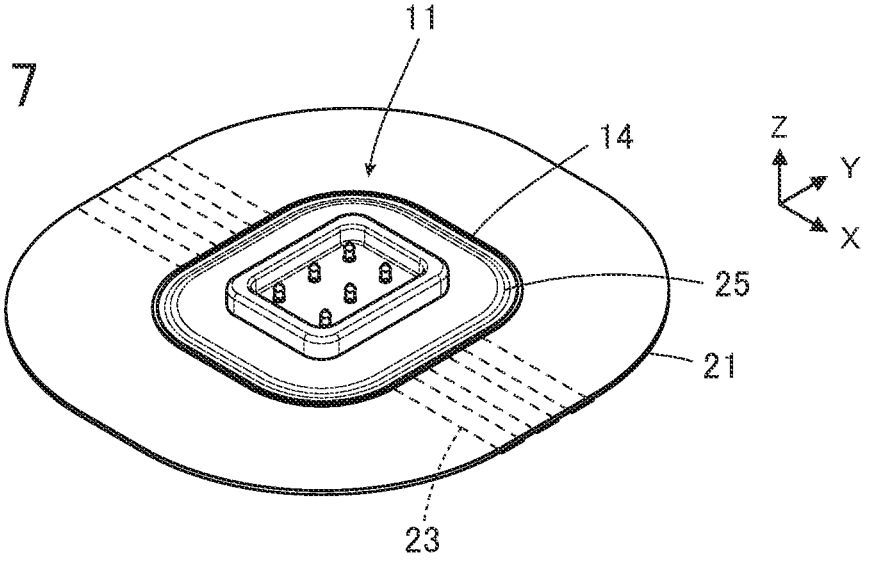
FIG. 17 is a perspective view illustrating the garment connector of Embodiment 1 attached to the garment.

Subsequently, as illustrated in FIG. 17, the peripheral edge portion of the connector fixation member 14 is sewn to the cloth 21 using an insulating yarn 25, and the connector fixation member 14 is fixed to the cloth 21 of garment. This allows the garment connector 11 to be attached to the garment.

Figure 18:
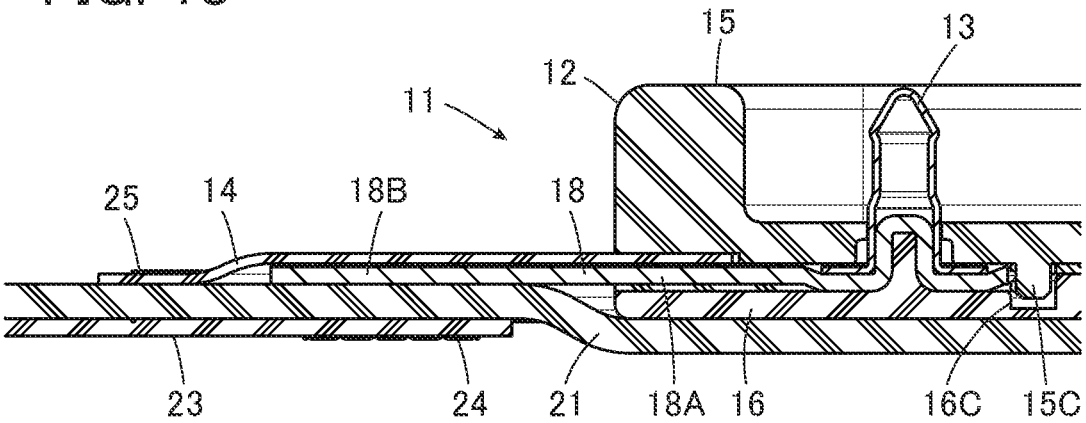
FIG. 18 is a partial cross-sectional view illustrating the garment connector of Embodiment 1 attached to a garment.

As illustrated in FIG. 18, the connector fixation member 14 in a sheet-like shape and the conductive member 18 are sandwiched between the first insulator 15 and the second insulator 16 of the connector body 12 to be held by the connector body 12, and the external conductive portions 18B of the conductive members 18 are sewn to the cloth 21 using the conductive yarn 24, so that the external conductive portions 18B and the garment-side conductor portions 23 are electrically connected to each other. The peripheral edge portion of the connector fixation member 14 is sewn to the cloth 21 using the insulating yarn 25, so that the garment connector 11 is attached to the garment.

In this way, the garment connector 11 can be attached to the garment by sewing the connector fixation member 14 to the cloth 21 at the exterior of the connector body 12 without sandwiching the cloth 21 of garment. This allows the garment connector 11 to be easily and firmly attached to the garment irrespective of the thickness of the garment. That is, the garment connector 11 includes none of parts of which sizes or the like need to be varied depending on the thickness of the cloth 21 of garment.

Further, the first waterproof sheet 19, the second waterproof sheet 20, and the permeable adhesive sheets S melt and then solidify, whereby waterproof is provided between the first insulator 15 and the second insulator 16, and thus, even if a garment to which the garment connector 11 is attached is, for example, exposed to rain or laundered, water is prevented from entering between the first insulator 15 and the second insulator 16.

Figure 19:
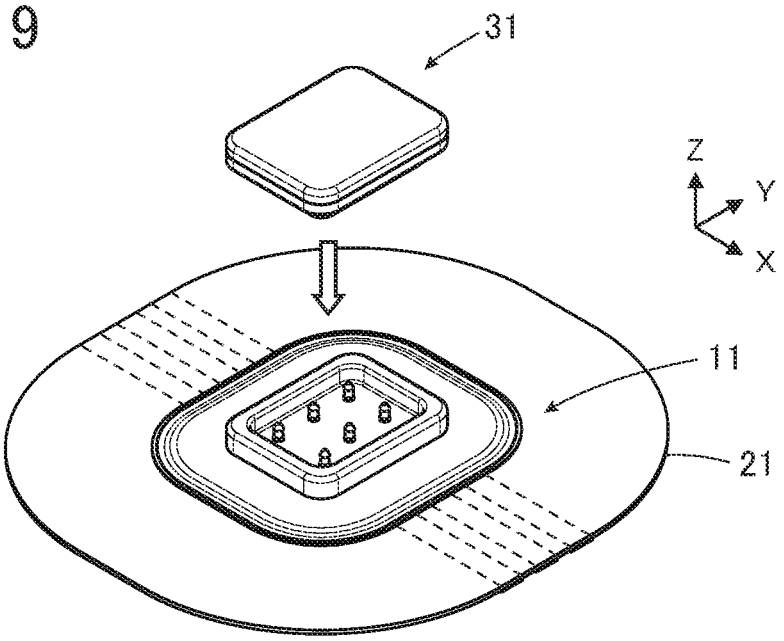
FIG. 19 is a perspective view illustrating a mating connector being aligned above the garment connector of Embodiment 1.

FIG. 19 illustrates an electronic equipment module 31 as a mating connector being aligned with the garment connector 11 attached to the cloth 21 of the garment.

Figure 20:
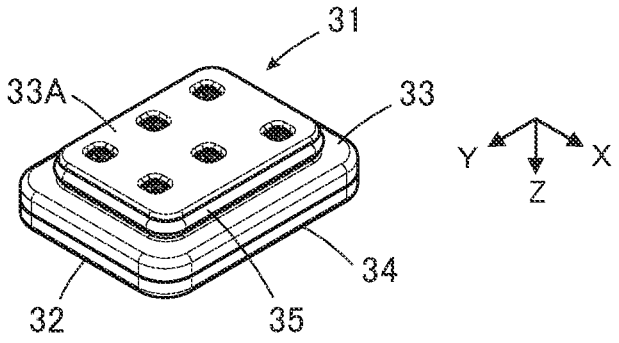
FIG. 20 is a perspective view of the mating connector as viewed obliquely from below.

The electronic equipment module 31 includes a housing 32 made of an insulating material as illustrated in FIG. 20. The housing 32 includes a first housing member 33 and a second housing member 34 coupled to the first housing member 33. The first housing member 33 includes a convex portion 33A protruding in the −Z direction and has a fitting ring 35 made of an elastic material such as rubber mounted onto the outer peripheral portion of the convex portion 33A to surround the convex portion 33A. The convex portion 33A is inserted into the mating connector receiving portion 17 in a concave form of the garment connector 11 when the electronic equipment module 31 is fitted into the garment connector 11.

Figure 21:
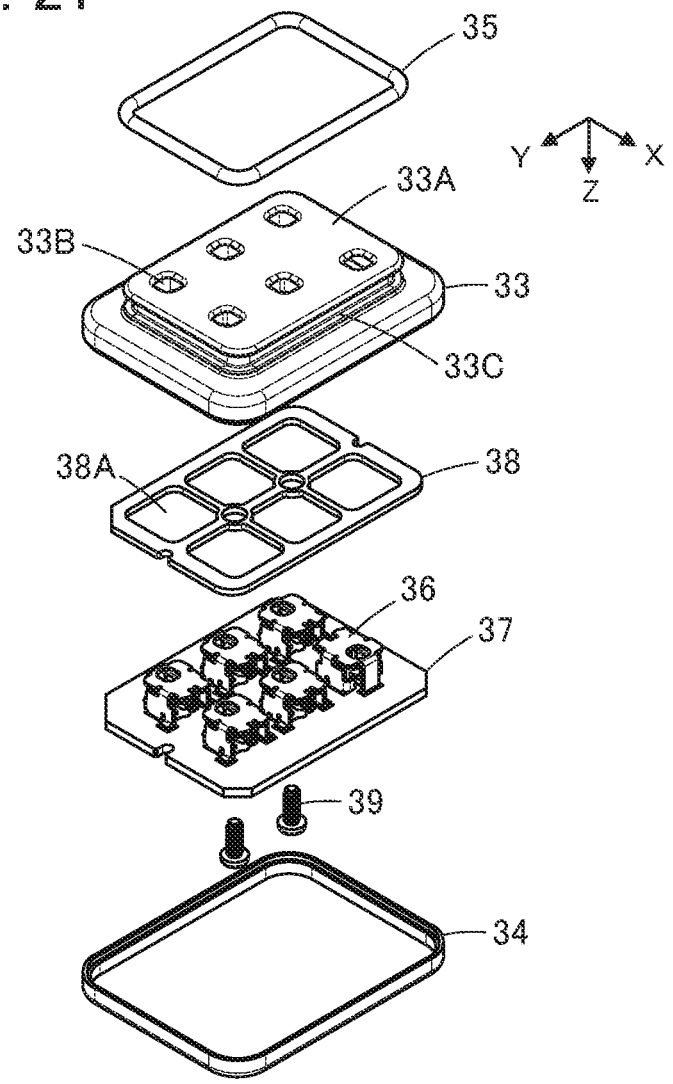
FIG. 21 is an exploded perspective view of the mating connector.

As illustrated in FIG. 21, the electronic equipment module 31 further includes a board 37 on which a plurality of contacts 36 are mounted, a waterproof member 38 disposed between the first housing member 33 and the board 37, and a fixing screw 39 for fixing the board 37 to the first housing member 33.

A plurality of contact receiving holes 33B corresponding to the plurality of contacts 13 of the garment connector 11 are formed on the face facing the −Z direction of the convex portion 33A of the first housing member 33. Further, a groove 33C for mounting the fitting ring 35 is formed on the external side face of the convex portion 33A to surround the convex portion 33A.

The contact 36 mounted on the board 37 is a receptacle-type contact that is connected to the plug-type contact 13 of the garment connector 11 when the electronic equipment module 31 is fitted into the garment connector 11, and is made of a conductive material such as metal.

In the waterproof member 38, a plurality of opening portions 38A into each of which the plurality of contacts 36 are each inserted are formed.

The board 37 on which the plurality of contacts 36 are mounted is fixed to the first housing member 33 by the fixing screws 39 with the waterproof member 38 interposed in between and the second housing member 34 is coupled to the first housing member 33, and the fitting ring 35 is mounted in the groove 33C of the convex portion 33A of the first housing member 33, whereby the electronic equipment module 31 illustrated in FIG. 20 is assembled.

Figure 22:
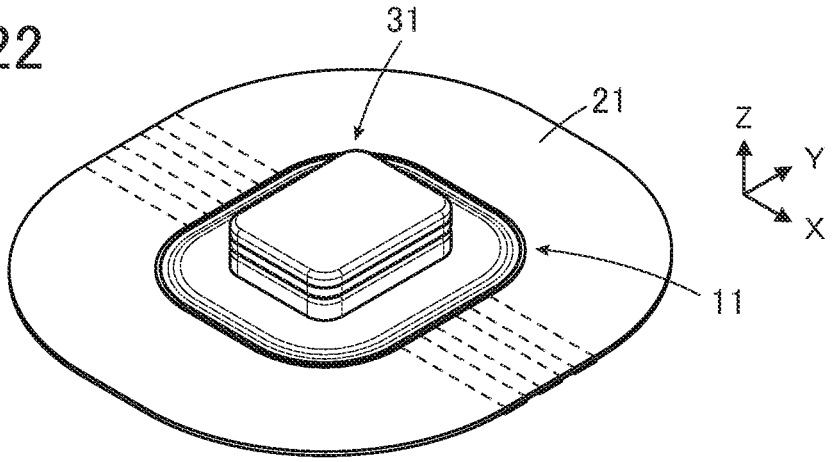
FIG. 22 is a perspective view illustrating the garment connector of Embodiment 1 into which the mating connector is fitted.

As illustrated in FIG. 22, when the electronic equipment module 31 is fitted into the garment connector 11, the convex portion 33A of the electronic equipment module 31 is inserted into the mating connector receiving portion 17 in a concave form of the garment connector 11. As such, the fitting ring 35 of the electronic equipment module 31 is compressed and deformed between the external side face of the convex portion 33A of the first housing member 33 and the mating connector receiving portion 17 in a concave form of the garment connector 11, so that the electronic equipment module 31 and the garment connector 11 are firmly fitted with each other, and thus water is prevented from entering between the electronic equipment module 31 and the garment connector 11.

Also, the convex portion 33A of the electronic equipment module 31 is inserted into the mating connector receiving portion 17 of the garment connector 11, so that the plurality of plug-type contacts 13 of the garment connector 11 are inserted into the plurality of receptacle-type contacts 36 through the plurality of the contact receiving holes 33B of the electronic equipment module 31 to be electrically connected to the plurality of receptacle-type contacts 36.

In this manner, the electronic equipment module 31 can be used as a wearable device connected to the garment-side connector portion.

Embodiment 2

Figure 23:
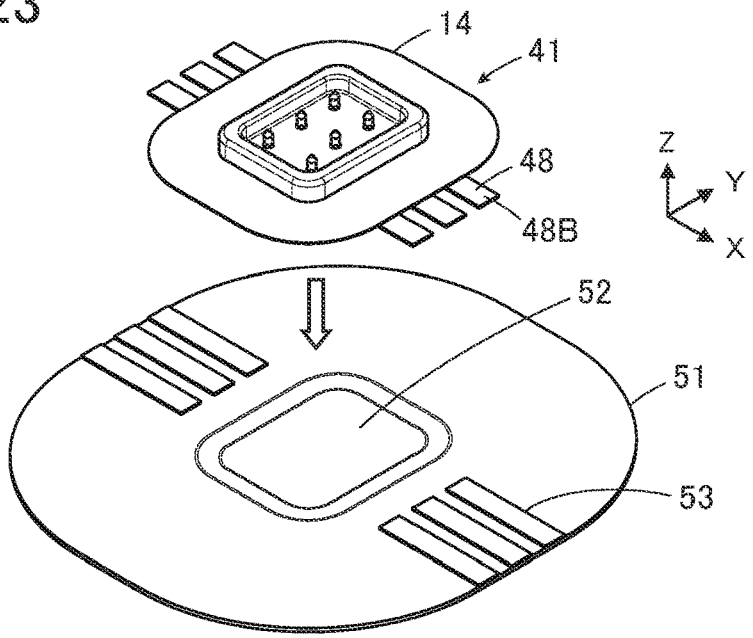
FIG. 23 is a perspective view illustrating the garment connector according to Embodiment 2 being aligned above the garment.

FIG. 23 illustrates a garment connector 41 according to Embodiment 2 and a cloth 51 of garment to which the garment connector 41 is to be attached.

In the garment connector 11 of Embodiment 1 described above, all of the external conductive portions 18B of the plurality of conductive members 18 disposed outside the connector body 12 are covered by the connector fixation member 14 as illustrated in FIG. 2, while in the garment connector 41 of Embodiment 2 illustrated in FIG. 23, the leading ends of external conductive portions 48B of a plurality of conductive members 48 extend to the outside of the connector fixation member 14. The garment connector 41 uses the plurality of conductive members 48 in place of the plurality of conductive members 18 in the garment connector 11 of Embodiment 1, and has the same configuration as the garment connector 11 excluding the conductive members 48. The conductive member 48 is made of conductive fibers as in the conductive member 18 in Embodiment 1.

Further, the cloth 21 of garment used in Embodiment 1 includes the plurality of garment-side conductor portions 23 arranged on the back face as illustrated in FIG. 15, while the cloth 51 of garment illustrated in FIG. 23 includes a plurality of garment-side conductor portions 53 arranged on the same front face as the face to which the garment connector 41 is attached.

Figure 24:
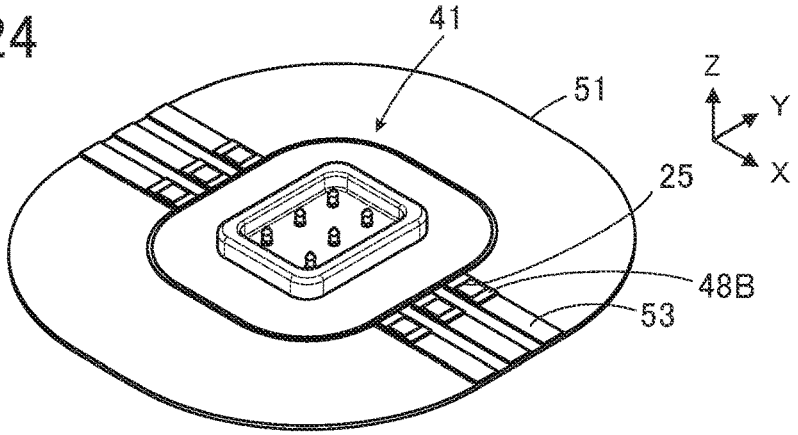
FIG. 24 is a perspective view illustrating the external conductive portions of the conductive members of the garment connector according to Embodiment 2 being sewn to a garment.

When the garment connector 41 is located at a connector attachment position 52 on the front face of the cloth 51 of garment, the leading ends of the external conductive portions 48B of the plurality of conductive members 48 of the garment connector 41 are located on the plurality of garment-side conductor portions 53 arranged on the front face of the cloth 51 and come into contact with the plurality of garment-side conductor portions 53, as illustrated in FIG. 24. Then, the external conductive portions 48B and the garment-side conductor portions 53 corresponding to each other are sewn up together with the cloth 51 using the insulating yarn 25. This allows the plurality of conductive members 48 of the garment connector 41 and the plurality of garment-side conductor portions 53 of the cloth 51 to be electrically connected to each other.

Note that, while the sewing can be performed using the conductive yarn 24 instead of the insulating yarn 25, the conductive yarn 24 is unnecessary to be used because the external conductive portions 48B and the garment-side conductor portions 53 are in contact with each other, and even the use of the insulating yarn 25 enables the conductive member 48 of the garment connector 41 to be electrically connected to the garment-side conductor portions 53 of the cloth 51. Also, the conductive member 48 of the garment connector 41 and the garment-side conductor portion 53 of the cloth 51 may be connected to each other, in addition to by sewing, for example, by adhering the conductive member 48 to the garment-side conductor portion 53 using a conductive adhesive, which enables these components to be electrically connected to each other.

In the garment connector 41 according to Embodiment 2, the leading end of the external conductive portion 48B of the conductive member 48 is exposed to the exterior of the connector fixation member 14, and thus, the external conductive portion 48B of the conductive member 48 can be sewn up without holding up the connector fixation member 14. However, provided that all the external conductive portions 18B of the plurality of conductive members 18 are covered by the connector fixation member 14 as in the garment connector 11 of Embodiment 1, although sewing needs to be performed while holding up the connector fixation member 14, covering the sewing portion with the connector fixation member 14 prevents the sewing portion from being exposed to rain, dust, and the like.

In addition, the garment connector 41, in which the leading ends of the external conductive portions 48B of the plurality of conductive members 48 extend to the exterior of the connector fixation member 14, can be attached onto the front face of the cloth 21 on the back face of which the plurality of garment-side conductor portions 23 are arranged as illustrated in FIG. 15. By sewing the external conductive portions 48B of the conductive members 48 of the garment connector 41 and the garment-side conductor portion 23 of the cloth 21 together with the cloth 21 using the conductive yarn 24 as in Embodiment 1, the conductive member 48 of the garment connector 41 and the garment-side conductor portion 23 of the cloth 21 can be electrically connected to each other.

Further, the garment connector 11 of Embodiment 1, in which all of the external conductive portions 18B of the plurality of conductive members 18 are covered by the connector fixation member 14, may also be attached onto the front face of the cloth 51 on which the plurality of garment-side conductor portions 53 are arranged as illustrated in FIG. 23. However, the plurality of garment-side conductor portions 53 of the cloth 51 each extend to a position corresponding to each of the external conductive portions 18B of the plurality of conductive members 18 of the garment connector 11 arranged on the front face of the cloth 51.

When the garment connector 41 is located at the connector attachment position 52 on the front face of the cloth 51 of garment, the external conductive portions 18B of the plurality of conductive members 18 of the garment connector 11 are located on the plurality of the garment-side conductor portions 53 arranged on the front face of the cloth 51 to come into contact with the plurality of garment-side conductor portions 53. Then, the external conductive portions 18B and the garment-side conductor portions 53 corresponding to each other may be sewn up together with the cloth 51 using the insulating yarn 25 while holding up the connector fixation member 14. This allows the conductive member 18 of the garment connector 11 to be electrically connected to the garment-side conductor portion 53 of the cloth 51.

Embodiment 3

In Embodiments 1 and 2 described above, the plurality of conductive members 18 and 48 are provided in the garment connectors 11 and 41, and the plurality of conductive members 18 and 48 are connected to the plurality of garment-side conductor portions 23 and 53 of the cloths 21 and 51 of garment; however, this does not limit the invention. For example, as illustrated in FIG. 25, a plurality of conductive members 68 are attached beforehand to a cloth 61 of garment, and the garment connector may also be assembled using these conductive members 68.

The cloth 61 includes an opening portion 62 at the connector attachment position, and the plurality of conductive members 68 are arranged such that each leading end is located in the opening portion 62. The conductive member 68 is made of conductive fibers as in the conductive member 18 in Embodiment 1.

Figure 25:
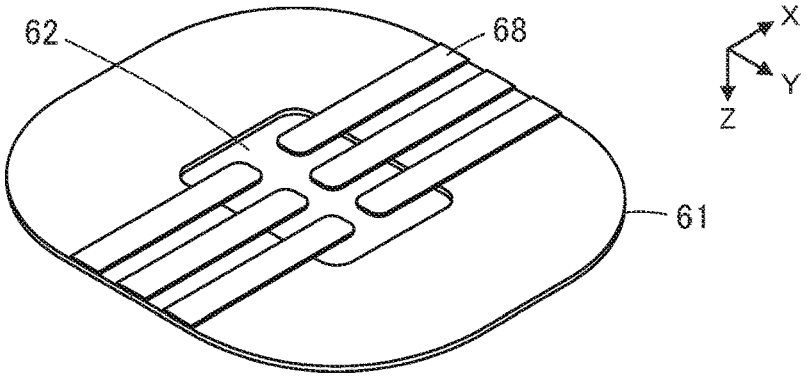
FIG. 25 is a perspective view illustrating conductive members attached beforehand to a garment, used in assembling the garment connector according to Embodiment 3.
Figure 26:
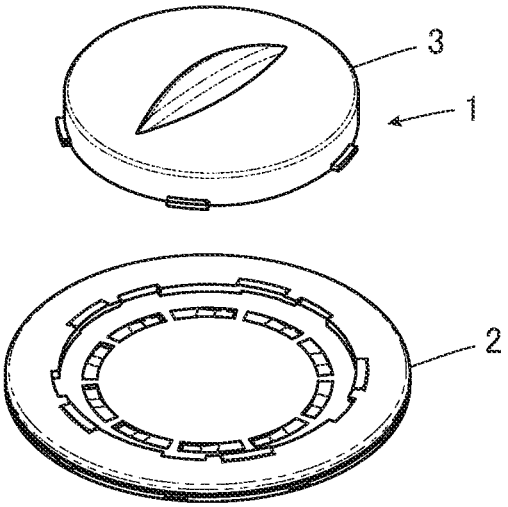
FIG. 26 PRIOR ART
FIG. 26 is a perspective view illustrating a known connector.
Figure 27:
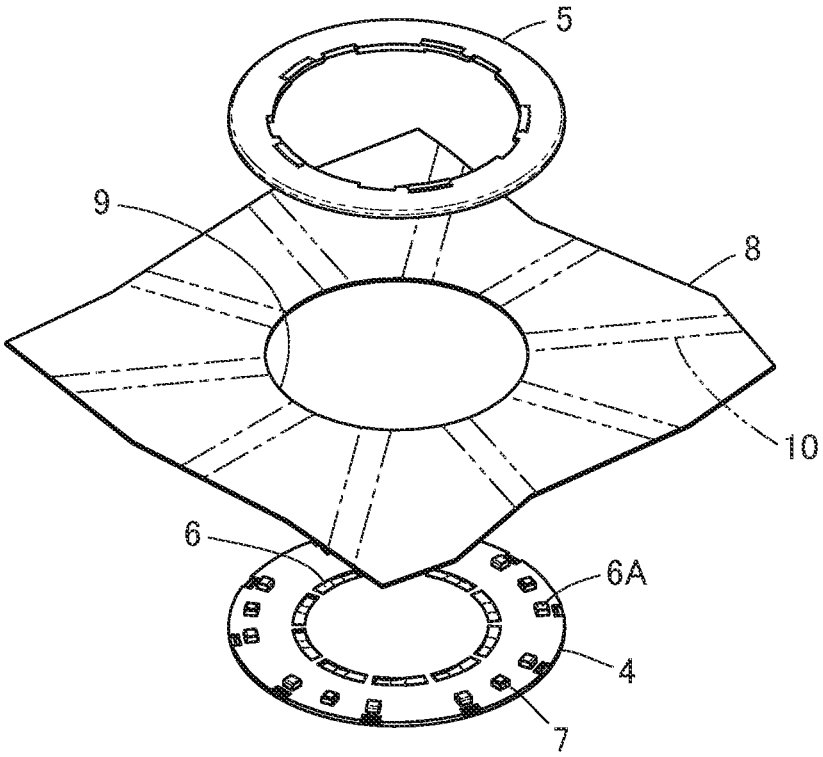
FIG. 27 PRIOR ART
FIG. 27 is a perspective view illustrating the known connector being attached to a cloth of garment.

For example, as illustrated in FIGS. 6 to 9, in a state where the connector fixation member 14 and the first waterproof sheet 19 are sequentially arranged on the −Z direction side of the first insulator 15 and the plurality of contacts 13 are assembled into the plurality of through holes 19A of the first waterproof sheet 19, the plurality of conductive members 68 of the cloth 61 illustrated in FIG. 25 are arranged on the first waterproof sheet 19 and the flanges 13B of the plurality of contacts 13. As illustrated in FIG. 25, the conductive member 68 attached to the cloth 61 is then arranged in place of the plurality of conductive members 18 in FIG. 10.

Further, as illustrated in FIGS. 11 to 13, the two permeable adhesive sheets S, the second waterproof sheet 20, and the second insulator 16 are sequentially stacked together, and then the heat treatment, the cooling treatment, and fusion-bonding of the leading end portions of the plurality of fixation protrusions 15B of the first insulator 15 are performed. This makes it possible to assemble a garment connector incorporating the plurality of conductive members 68 of the cloth 61.

Note that although the conductive members 18, 48, and 68 used in Embodiments 1 to 3 are all made of conductive fibers, a resin or cloth coated with a conductive film on the surface thereof may also be used, for example.

As illustrated in FIG. 14, although the contact protrusion 16A of the second insulator 16 is inserted into the protrusion receiving portion 13C of the contact 13 with the conductive member 18 having flexibility interposed in between, so that the contact 13 is electrically connected to the conductive member 18. However, the conductive member 18 does not need to have flexibility in a case where the contact 13 is electrically connected to the conductive member 18 using soldering or the like, for example. Accordingly, the conductive members 18, 48, and 68 in Embodiments 1 to 3 may also be formed with a metal plate or the like.

In Embodiments 1 and 2, the plurality of conductive members 18 and 48 are arranged on the −Z direction side of the connector fixation member 14; however, the invention is not limited thereto, and the plurality of conductive members 18 and 48 may be arranged on the +Z direction side of the connector fixation member 14. However, in a case where the conductive members 18 and 48 do not extend to the exterior of the connector fixation member 14, the external conductive portions 18B and 48B of the conductive members 18 and 48 and the garment-side conductor portions 23 and 53 need to be sewn up together with the connector fixation member 14 using the conductive yarn 24 to electrically connect the conductive members 18 and 48 to the garment-side conductor portions 23 and 53.

The conductive members 68 used in Embodiment 3 may also be configured to be arranged on the +Z direction side of the connector fixation member 14.

Note that, while the plurality of conductive members 18 and 48 in Embodiments 1 and 2 are members independent from the connector fixation member 14, the plurality of conductive members 18 and 48 may be attached beforehand to the connector fixation member 14.

In Embodiments 1 to 3, the six contacts 13 and the six conductive members 18, 48, and 68 are used; however, the invention is not limited thereto, and it may have one or more contacts 13 and one or more conductive members 18, 48, and 68.

In Embodiments 1 and 2, the garment connectors 11 and 41 include a plurality of plug-type contacts 13, and the electronic equipment module 31 includes a plurality of receptacle-type contacts 36. Contrarily, the garment connectors 11 and 41 may include a plurality of receptacle-type contacts 36 and the electronic equipment module 31 may include a plurality of plug-type contacts 13.

What is claimed is:

1. A garment connector comprising:

a connector body;

one or more contacts held by the connector body;

one or more conductive members held by the connector body and corresponding to the one or more contacts, each of the one or more conductive members being fabricated into a cloth form using conductive fibers and having both conductivity and flexibility; and a connector fixation member in a sheet-like shape held by the connector body and extending to an exterior of the connector body, wherein each of the one or more conductive members comprises:

an internal conductive portion disposed inside the connector body and connected to a corresponding one of the one or more contacts; and an external conductive portion disposed outside the connector body, at least a part of the external conductive portion extending along the connector fixation member, wherein the garment connector is attached to a garment by fixing the connector fixation member to the garment at the exterior of the connector body, wherein the connector body comprises:

a first insulator exposed toward an outside of the garment when the connector fixation member is fixed to the garment; and a second insulator disposed further inside the garment than the first insulator and coupled to the first insulator.

2. The garment connector according to claim 1, wherein the connector fixation member extends outside the connector body to surround an outer peripheral portion of the connector body.

3. The garment connector according to claim 1, wherein at least a part of the external conductive portion is covered by the connector fixation member.

4. The garment connector according to claim 1, wherein the connector fixation member includes an opening portion located inside the connector body, and the one or more contacts are connected to the internal conductive portions of the one or more conductive members within the opening portion of the connector fixation member.

5. The garment connector according to claim 1, wherein the connector fixation member has insulating properties and is made of resin or cloth.

6. The garment connector according to claim 1, wherein the connector fixation member is fixed to the garment by sewing.

7. The garment connector according to claim 1, wherein the first insulator includes a plurality of fixation protrusions protruding toward the second insulator, the second insulator includes a plurality of through holes corresponding to the plurality of fixation protrusions of the first insulator, and the first insulator and the second insulator are coupled to each other in a state where the plurality of fixation protrusions are inserted into the plurality of through holes.

8. The garment connector according to claim 1, wherein by sandwiching the internal conductive portion between the first insulator and the second insulator, the one or more conductive members are held by the connector body.

9. The garment connector according to claim 8, wherein a first waterproof sheet is disposed between the first insulator and the internal conductive portions of the one or more conductive members and a second waterproof sheet is disposed between the second insulator and the internal conductive portions of the one or more conductive members.

10. The garment connector according to claim 9, wherein each of the first waterproof sheet and the second waterproof sheet is made of an adhesive.

11. The garment connector according to claim 10, wherein the adhesive infiltrates an interior of the internal conductive portions of the one or more conductive members.

12. The garment connector according to claim 1, wherein each of the one or more contacts includes a projecting portion projecting outward from the garment when the connector fixation member is fixed to the garment, and a flange formed at a base end of the projecting portion, the first insulator includes one or more contact attachment holes through each of which the projecting portion of a corresponding one of the one or more contacts passes, and each of the one or more contacts is held by the connector body in a state where the projecting portion is inserted into a corresponding contact attachment hole of the first insulator and the flange is sandwiched between the first insulator and the second insulator.

13. The garment connector according to claim 12, wherein the second insulator includes one or more contact protrusions protruding toward the one or more contacts, the projecting portion of each of the one or more contacts includes a protrusion receiving portion in a concave form, and each of the one or more contact protrusions is inserted into the protrusion receiving portion of a corresponding one of the one or more contacts with a corresponding one of the one or more conductive members interposed therebetween such that the corresponding one of the one or more conductive members is electrically connected to the corresponding one of the one or more contacts.

14. The garment connector according to claim 12, wherein the first insulator includes a mating connector receiving portion in a concave form, and the projecting portion of each of the one or more contacts protrudes into the mating connector receiving portion.

15. The garment connector according to claim 1, wherein by sandwiching the connector fixation member between the first insulator and the second insulator at a position different from the one or more contacts and the one or more conductive members, the connector fixation member is held by the connector body.

16. The garment connector according to claim 1, wherein the external conductive portion of each of the one or more conductive members is electrically connected to a corresponding one of one or more garment-side conductive portions of the garment.

17. The garment connector according to claim 16, wherein the external conductive portion of each of the one or more conductive members and the corresponding one of the one or more garment-side conductive portions are in contact with each other to be electrically connected to each other.

18. The garment connector according to claim 16, wherein the external conductive portion of each of the one or more conductive members and the corresponding one of the one or more garment-side conductive portions are disposed on both faces of a cloth forming the garment, respectively, and are sewn up together with the cloth using a conductive yarn to be electrically connected to each other.

19. The garment connector according to claim 1, wherein the one or more conductive members are attached beforehand to the garment.

* * * * *